US005588319A

United States Patent [19]

Bianchi et al.

[11] Patent Number: 5,588,319

[45] Date of Patent: Dec. 31, 1996

[54] METHOD AND APPARATUS FOR MAKING HEAT EXCHANGER FINS

[75] Inventors: Sabatino A. Bianchi, Bloomfield Hills; Richard P. Stoynoff, Woodhaven, both of Mich.

[73] Assignee: Livernois Research & Development Company, Dearborn, Mich.

[21] Appl. No.: 554,542

[22] Filed: Nov. 7, 1995

Related U.S. Application Data

[63] Continuation-in-part of Ser. No. 170,720, Dec. 21, 1993, abandoned.

[51] Int. Cl.[6] ..... B21D 37/01; B21D 53/06

[52] U.S. Cl. ..... 72/186; 72/462; 76/DIG. 11

[58] Field of Search ..... 72/186, 462, 325; 76/DIG. 11

[56] References Cited

U.S. PATENT DOCUMENTS 3,145,586 8/1964 Brearley et al. .
3,211,118 10/1965 Donaldson .
3,214,954 11/1965 Rhodes et al. .
3,228,367 1/1966 Donaldson .
3,258,832 7/1966 Gerstung .
3,318,128 5/1967 Rhodes .
3,433,044 3/1969 Rhodes et al. .
3,998,600 12/1976 Wallis .
4,067,219 1/1978 Bianchi .

FOREIGN PATENT DOCUMENTS 1293911 11/1989 Japan .

*Primary Examiner*—Lowell A. Larson
*Attorney, Agent, or Firm*—Brooks & Kushman PC

[57] ABSTRACT

A method and apparatus for forming a strip of fins with louvers comprising providing fin forming rolls comprising stacked carbide plates having rolling and cutting edges forming fins with louvers, and directing a strip of clad aluminum between an opposed pair of fin forming rolls. The carbide plates are preferably made of carbide containing tungsten, cobalt and carbon, wherein the major constituent is tungsten.

9 Claims, 2 Drawing Sheets

METHOD AND APPARATUS FOR MAKING HEAT EXCHANGER FINS

This is a continuation-in-part application of U.S. Ser. No. 08/170,720, filed Dec. 21, 1993, now abandoned.

TECHNICAL FIELD

This invention relates to tooling and particularly to fin rolls with specialty equipment used to produce heat exchanger fins having louvers therein. Such exchangers are found, for example, in an automobile radiator, heater/air conditioner, evaporator, turbo-inner cooler heat exchangers and oil coolers.

BACKGROUND ART

Fin tooling can be described as a plurality of stacked plates having cutting and forming teeth on their periphery. Prior approaches leave unsatisfied a need for an improved plate construction that takes advantage of certain characteristics common in nonferrous materials. Typical patents showing rolls used for making fins with louvers are shown in U.S. Pat. Nos. 3,214,954; 3,318,128; 3,998,600; and 4,067,219.

The heat exchange industry has rapidly changed from producing copper/brass heat exchangers to aluminum heat exchangers utilizing fin strips. This change has occurred primarily to take advantage of the weight reduction aluminum offers. The aluminum strips can be bonded by several braze methods such as vacuum brazing, flux brazing, and controlled atmosphere brazing to name a few. In recent years controlled atmosphere brazing (CAB) has become a brazing method of choice. The CAB process requires the use of clad aluminum alloys on the aluminum strip that is subsequently formed into fins. The clad is made up of 5–7% silicon, ranging in thickness from 1% to 10% of the total material thickness. This clad typically covers one or both sides of a base aluminum alloy. Silicon is best known for its abrasive qualities and these tendencies are the same when used as a cladding for fin material.

Consequently, fin rolls produced from the standard hardened steel plates wear much more rapidly when silicon clad aluminum fin material is formed than when non clad aluminum or copper fin materials are formed. This problem is most severe in fin rolls for making fins with louvers. Although this problem has long existed, the problem has not been solved by prior approaches.

Current steel roll technology is limited by the hardness that can be achieved through known heat treating processes. Significant hardness can be achieved with steel but at the expense of losing other desirable properties such as ductility and crack resistance. It is desirable to produce fin rolls with the hardest available material in order to enhance the bearing effectiveness, i.e., the ratio of soft to hard is directly related to the amount of friction created. This may reduce the amount of oil consumed during the forming process.

Steel rolls secondly have the tendency to corrode due to dissimilar metals in combination with numerous combinations of lubricants used in the fin forming process. Once corrosion begins, the pitting areas will rapidly diminish the roll's ability to make clean cuts and forms to the tolerances required for optimal heat exchanger performance. Steel rolls also become magnetized through repeated contact with each other. This magnetic field causes ferrous metal fines to cling to the rolls and consequently find their way to the sharp cutting surfaces. When these metal fines are sheared by the cutting surfaces, a dulling of the cutting surfaces occurs.

Finally, the grain structure and surface density of steel have an effect on the tendency of aluminum to attach itself to the steel roll surface. The smaller the grain structure and the denser the rolls' surface, the less galling occurs.

OBJECTIVES OF THE INVENTION

An object of the present invention is to significantly improve fin roll life through material changes in the forming roll, yet still be able to use known manufacturing processes to produce fin forming tools.

SUMMARY OF THE INVENTION

This object has been attained by clearly identifying the reasons steel rolls wear and specifying a material that either eliminates or minimizes those factors.

It has thus been an object to combine the best attributes of roll design, material properties, and known manufacturing processes to produce the highest value fin rolls produced today.

In accordance with the invention, this object has been achieved by providing a heat exchange fin manufacturing tool that utilizes the unique material characteristics of a carbide, i.e., hardness, brittleness, corrosion resistance, and surface density.

DETAILED DESCRIPTION OF THE PREFERRED EMBODIMENTS

Manufacturing Apparatus

The method and apparatus embodying the invention is as disclosed in the aforementioned United States patents and particularly U.S. Pat. No. 4,067,219. Each of these patents is incorporated herein by reference.

Such conventional fin roll machines include a pair of form rolls and mounted on the frame of the machine in intermeshing relation. Sheet metal ribbon stock is fed from a paid of feed rollers (not illustrated) between the form rolls so as to form corrugations therein, the strip emerging from the form rolls. As the corrugated strip emerges from form rolls, it is guided by rails to a pair of gathering rolls which advances the corrugated strip towards a spring pressure plate. The pressure plate cooperates with the rail to frictionally retard advancing movement of the corrugated strip so that it is gathered or compressed lengthwise by further bending at the crests of the convolutions into its finished form.

The present invention is directed to the structure and function of the form rolls.

The remainder of the apparatus is conventional and may comprise devices other than those specifically illustrated.

The Product Manufactured

The finished strip comprises successive convolutions connected by return bends at the opposite ends thereof. Each convolution is formed with a plurality of fins or louvers which are cut and twisted so that they project from opposite sides of each convolution—ideally with an absence of burring and angular variation of the louver.

Fin Forming Rolls

In accordance with the present invention, the fin rolls are made of a material having the properties of a carbide and preferably of a carbide having the following chemical composition by weight:

| | Range | Preferred |
|---|---|---|
| Carbon | 5–6% | 5.42% |
| Nickel | 0.01–0.10 | 0.07% |
| Tungsten | 80–82 | 81.75% |
| Cobalt | 12–13 | 12.35% |
| Tantalum | 0.001–0.004 | 0.003% |
| Iron | 0.01–0.02 | 0.01% |

One suitable material is available from Fansteel of Latrobe, Pa. (grade HC-500). Its nominal properties are: 13.0% cobalt; fine grain structure; Rockwell hardness 89–91 ($R_c$); transverse rupture 410,000; and density 14.22 grams per cc.

Test Results

Figure 1:
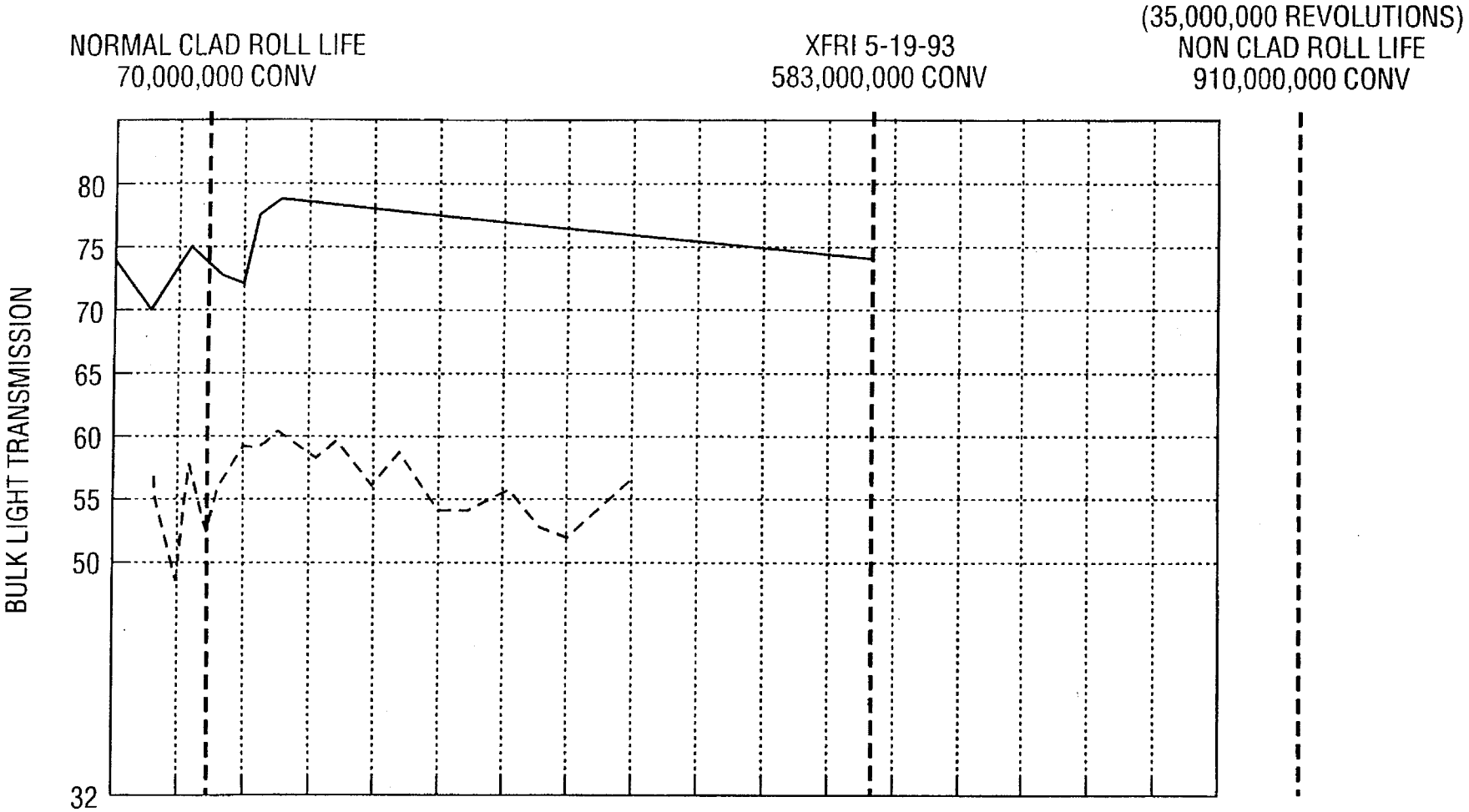
FIG. 1 is a diagram showing tests made by bulk light transmission versus convolutions for two prolonged tests.

Tests have shown that unexpectedly, wear is reduced and the resultant life of fin rolls is extended far beyond that heretofore obtained by steel rolls, as shown in FIG. 1.

Fin roll tooling wear is measured by inspection of the fins produced. As fin rolls wear, the louvered fins produced by prior art rolls exhibit a continuing gradual reduction of the angle of the individual louvers, as well as a deterioration in the quality of the louver slitting action (which will be evidenced by the presence of burrs, and eventually, a tearing-rather than slitting-of the fin material as the louvers are produced).

There are several reliable methods for checking both reduction of louver angle and slitting quality deterioration. It is customary to perform tests to ensure that the fin roll tooling does not have adverse wear and that the quality of the fins and louvers meet acceptance criteria. One of the tests for measuring louver angles is shown in "Measuring Radiator Air Center Louver Angles," SOCIETY OF MFG. ENGINEERS, 1989 which is incorporated herein by reference. The expected life of fin rolls is measured by the number of fins or convolutions produced until the quality of fins of the roll no longer meets criteria for being acceptable.

FIG. 1 shows production comparisons of louver angle and bulk light transmission data. These two terms are common industry measurements primarily used to predict fin heat transfer performance prior to assembly in the end product, i.e., condensers, radiators, oil coolers, etc. Similar data can be demonstrated by multiple customers currently running these types of fin rolls. It is this type of dramatic test data that further emphasizes the unexpected results experienced.

With a new, sharp roll properly installed in a mill, a bulk transmission value of 80–95% will typically be observed. As the roll wears, the bulk transmission values gradually and steadily become lower because of louver burrs created by the dulling surfaces of the shears.

As shown in FIG. 1, standard rolls typically may have an expected life of about 70,000,000 convolutions when producing clad aluminum fins (actual life for different users may vary depending on the user's criteria for acceptance of part quality and manufacturing practices).

In the test, a standard set of rolls produced 70,000,000 fin convolutions until the set was no longer able to produce fins of acceptable quality. This production was completed in twenty-four days, operating twenty-four hours per day.

A second set of carbide rolls, by comparison, producing an identical part from identical material under identical conditions have been in production for more than one year, twenty-four hours per day, and have produced more than 2,500,000,000 (2.5 billion) convolutions are still operating, and currently show no measurable wear of the rolls based on identical criteria for judging roll wear—at least a 15 fold increase in performance.

These convolution counts are only estimates due to the fact that as of the time of filing this patent application, no rolls in service have worn out in the traditional sense. The rolls in service to date have only been made unusable as a result of a sharp physical force exerted against the forming action, such as wrap-up or introducing something foreign into the roll while in operation.

Manufacturing Process

In the making of heat exchanger fins for louvers, the stacked array of fin roll blades or plates cut and form strips.

The fin roll blades perform multiple functions in their intended application. The blade's primary functions are to simultaneously form metal into a corrugated shape and very accurately cut or slit louvers and form them to a desired degree of opening. In order to provide the desired product, the fin rolls must accurately produce the desired corrugated shape and cut or slit the louvers without removing material. Any tendency to "galling" (metal adhering to the blades of the rolls) will adversely affect the final product.

Prior Art Distinguished

The Brearley U.S. Pat. No. 3,145,586 defines a stamping operation that shears and removes sections of material from the original stock. Material is removed from the original stock and is primarily accomplished by a reciprocating action. In the present invention, the fin roll blade forms and slits the metal stock simultaneously and does not remove material from the original stock. In the '586 disclosure, the fin roll blade is operated in a rotary action which further accentuates potential "galling" (metal adhering to the blade) which can cause the blades to separate due to material buildup.

The Yawa JA 1293-911-A patent depicts a work roll for a rolling mill having an outside surface coated with a cermet material. Unlike the present case, the work piece is primarily formed into a shape only through a rotary action. On contrast to the present invention, the rolls are completely separated from one another by the stock material being formed. The invention here calls for fin roll blades to be manufactured to such close tolerances that basically zero blade clearance is achieved in their stacked condition.

The Brearley and Yawa patents make no mention of the corrosion reduction offered through the use of carbides. Nor do they acknowledge that the base material of the blades would remain steel and thereby have the tendency to become magnetized as the blades contact each other. This magnetic tendency can cause steel metal fines to become attracted to the fin rolls which subsequently dulls the cutting surfaces. Additionally, the non-galling tendency of carbide is not addressed or discussed.

Known carbide materials are used for metal removal (end mills), metal forming (roll or reciprocating dies), stamping dies (forming and piercing dies), and material slitting (slitters). These industries each have their own unique reasons for using carbides, which differ substantially from carbides used for making fin rolls.

The fin roll blade's function requires the simultaneous corrugating, slitting, and louver forming of metal stock. If any one of these functions deteriorate more rapidly than the other, blades must be reprofiled or scraped and replaced. Carbide may be used to overcome the wear associated with the slitting function. But carbide is also used to improve each of the roll functions: corrugating, slitting, and louver forming. The nonmagnetic properties of carbide is an added benefit over common tool steels.

The present invention permits the use of higher efficiency air conditioning condensers by the automotive industry. This style of condenser is necessary in many automotive applications to make up for the performance reduction caused by the change from R12 and R134 freon (non-ozone depleting air conditioning coolants). There is a hesitancy to use high efficiency condensers due to the expensive nature of the fin roll tooling and its rapid deterioration with normal industry accepted tool steels. Through the advent of the carbide based fin rolls, this rapid deterioration has been effectively addressed.

Carbide materials which are very brittle have solved problems in connection with the making of fin rolls. It was not obvious that carbide fin rolls would function satisfactorily until the inventors became familiar with the present invention and the results of tests.

Wear Mechanism

To develop an understanding of the mechanism by which the disclosed rolls have a longer life than the prior art, the inventors have studied the failure mode of the metal structure of which the rolls are made. They have discovered that the cutting edges provided upon each roll begin their service life with a primary cutting edge. As service continues, failure begins to occur. The microscopic appearance of resulting fracture surfaces at the cutting edge reveal a continual replacement of the primary by secondary cutting surfaces by a process of self-rejuvenation, which tend to retain the sharpness of their primary predecessors.

Figure 2:
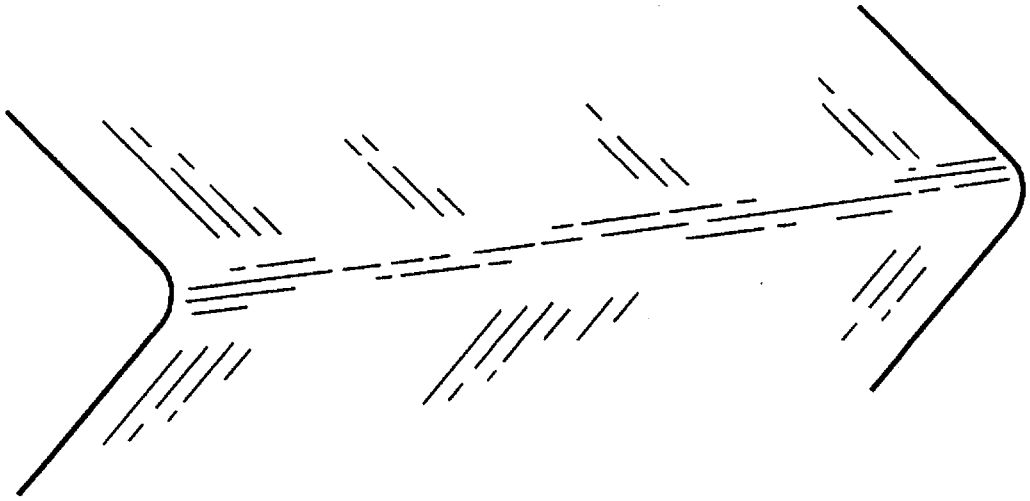
Fig. 2 (PRIOR ART)
FIG. 2 depicts a prior art cutting edge after exposure to service conditions.

In FIG. 2, there is depicted schematically an edge profile of a conventional material after having been exposed to service conditions. Noteworthy is the doughing or rounding of the cutting edge caused by surface damage such as wear or plastic distortion.

Figure 3:
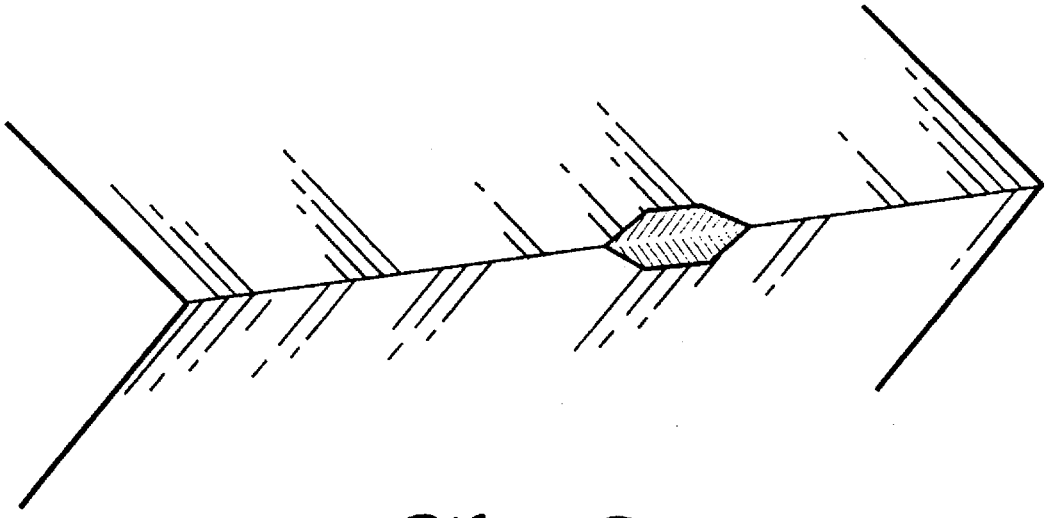
FIG. 3 depicts a cutting edge according to the present invention after exposure to service conditions.

In contrast, the inventors' structure depicted in FIG. 3 includes a primary cutting surface 10 and a secondary cutting surface 12. On a microscopic scale, after a long service life, brittle or fatigue fractures or fractures resulting from the combined effects of stress and environment have produced the secondary cutting surface 12 which has retained a sharp edge. No appreciable amount of plastic deformation has occurred either in the primary cutting edge 10 or secondary brittle fracture surface 12.

As is typical with brittle tensile or compression fractures, the exposed surface tends to have a bright, granular appearance. Such fractures generally are of the flat type (FIG. 3), that is, normal (perpendicular) to the direction of the maximum tensile stress. FIG. 3 illustrates what may often appear as a chevron pattern which points to the origin of the crack.

FIG. 3 illustrates a roll cutting blade according to the present invention after 500,000 pounds of fin material have been run through the cutting blades. Also shown is a small chip on the blade's edge. Inspection has confirmed that the cutting edge is similar to prior art edges in width and definition, even though the prior art material (FIG. 2) was subjected to only 33,000 pounds of fin material run through the blades.

The inventors have determined that abrasion contributes to the simultaneous cutting, forming, and deformation of the louvered fin. As is known, abrasion is the process of removing material from a surface by means of a series of miniature cutting operations, usually conducted by sharp, hard particles that are rubbed against the surface. In the present invention, such sharp, hard particles are generated by localized brittle fracture debris when a carbide tooth is exposed to prolonged service. The abrasion process is generally more effective if the hard particles are prevented from rotating by embedding them in a soft surface, such as the material of which the fin is to be formed.

The results of the present test are surprising because it is commonly found that when two surfaces (such as the carbide roll and the aluminum fin) are in sliding contact, it is the harder one (the carbide roll) that wears. This is because the particles that cause abrasion would normally be expected to become embedded in the softer material (aluminum fin) and abrade the harder one.

To show the differences in tooling wear between the inventive material and prior art tool steels, a tool steel was selected that was manufactured by Crucible Particle Metallurgy (CPM-10V). That product is said to exhibit a combination of exceptionally good wear resistance, toughness, and strength for cold and warm work applications. The Crucible data sheet states that "the exceptional wear resistance and good toughness of CPM-10V also make this tool steel an excellent candidate to replace carbide and other highly wear resistant materials in cold work tooling applications, particularly where tool breakage or chipping is a problem or where cost effectiveness can be demonstrated." Typical applications are stated to include knives for slitting, shearing, trimming, etc.

Experiments have determined that the material of the present invention can correctly form a fin over a period at least 15 times longer in duration than conventional CPM-10V. It is thought that this is achieved by the inventive material providing superior abrasion resistance and having a cutting surface wear mode that exhibits micro chipping, rather than a rounding, or smearing of the cutting surface.

For comparison, 33,000 pounds of material were run through a CPM-10V form roll. 500,000 pounds of material were run through a form roll made of the inventive material. As of the date of filing this patent application, fin rolls made of the inventive material have not worn out at any customer site. Inspection of the cutting edge (FIG. 2) confirms the non-defined or dulled cutting surface produced from abrasion of the fin material. The result is poor louver cutting action.

Inspection of a single louver panel cut with the inventive material confirms that the louver is cut cleanly without burrs or demarcations. Such observations are confirmed by the techniques depicted in FIG. 1.

The dull cutting action manifested in the prior art produces a jagged edge in a single louver panel cut with a CPM-10V form roll after being in service. Noteworthy is that the louvers are almost completely closed at one end from burring. One consequence is a significant diminution in heat transfer capability of the serpentine fin roll.

From these observations, the inventors have concluded that the form roll cutting edge wear mechanisms between the material of the present invention and prior art material, such as CPM-10V, are markedly different. The inventive material form roll cutting edge shows micro chipping (FIG. 3), whereas the CPM-10V material form roll cutting edge (FIG. 2) shows actual wearing or rounding.

Test results confirm that micro chipping of the cutting blades of the present invention does not affect the end product quality, i.e. the resulting louvers continue to be well defined, without sacrifice of heat transfer efficiency. In contrast, louver panels prepared by prior art tool materials tend to show wearing or rounding which has an adverse effect on product quality, i.e. poorly formed and defined louvers.

It is expected that any material exhibiting the wear resistance characteristic and having the wear failure mode of the cutting edge to generate micro chips would create a superior long life fin forming blade. Though the CPM-10V material exhibits superior wear resistance, the mode of failure (wear or rounding of the cutting edge) causes the fin forming blades produced by this material to have a significantly shorter useful production life.

Using the inventive structure, serpentine fins have been made with a throughput rate of 1,000 feet per minute with an angular variation of only ±2°. The fin height has been controlled at ±0.0005 of an inch, with a guarantee of fin height control equalling ±0.0025 of an inch.

One advantage to symmetry through quality form rolling is the fact that the end of each louver will be closer to the tube through which a heat transferring medium flows. This close tube-to-louver distance provides a better ability to transfer heat from the tube and can only be obtained using star-shaped form rolls of acceptable quality.

Thus, Applicants have harnessed what conventionally has been an undesirable property (brittleness) and have put it to good use: to create a continually rejuvenated, sharp cutting edge of the cutting blade in actual service conditions.

We claim:

1. A heat exchange fin manufacturing tool for forming a strip of fins with louvers comprising fin forming rolls including stacked carbide plates having edges for rolling, cutting and forming fins with louvers that are cut and twisted so that they project from each fin, the tool having the characteristic of enhanced wear resistance, each edge having a primary cutting surface for rolling, cutting, and forming fins before localized brittle fracture occurs during service life; and a secondary cutting edge extending from the primary cutting edge as a result of localized brittle fracture after exposure to service conditions, the secondary cutting edge continually replacing the primary cutting edge in a self-rejuvenated manner with renewed rolling, cutting, and forming ability.

2. The tool set forth in claim 1 wherein said carbide plates consist essentially of about 80–82% tungsten, about 12–13% cobalt and about 5–6% carbon with effective amounts of nickel, iron, and tantalum.

3. The tool of claim 1, wherein the rolls are contiguous.

4. The tool of claim 1, wherein each fin forming roll is uncoated.

5. A method for forming a strip of fins with louvers comprising providing opposing, intermeshing fin forming rolls including stacked carbide plates having edges for rolling, cutting, and forming fins with louvers that are cut and twisted so that they project from each fin;

wherein each edge includes a primary cutting surface for rolling, cutting, and forming fins before brittle fracture occurs during service life; and a secondary cutting edge extending from the primary cutting edge after exposure to service conditions, the secondary cutting edge replacing the primary cutting edge with renewed rolling, cutting, and forming ability; and directing a strip between an opposed pair of said fin forming rolls to roll, cut and form fins with louvers with minimal removal of material from the strip.

6. The method set forth in claim 5 wherein said carbide plates consist essentially of about 80–82% tungsten, about 12–13% cobalt and about 5–6% carbon with effective amounts of nickel, iron, and tantalum.

7. The method set forth in claim 5 wherein the step of directing a strip between the opposed pair of fin forming rolls includes:

directing the strip at a rate of up to about 1,000 feet per minute so that the resulting strip includes louvers which are formed within 2° of a desired angle without burring of louvers formed thereby.

8. The method of claim 5, wherein the forming step comprises simultaneous corrugating, slitting, and louver forming.

9. The method of claim 5, wherein the forming step is achieved without magnetizing the forming rolls.

* * * * *